US008074318B2

(12) United States Patent
Launiemi

(10) Patent No.: US 8,074,318 B2
(45) Date of Patent: Dec. 13, 2011

(54) ARRANGEMENT FOR COUPLING BRUSH ELEMENTS IN A BRUSH BODY

(75) Inventor: Markku Launiemi, Nokia (FI)

(73) Assignee: Al-Jon Manufacturing LLC, Ottumwa, IA (US)

( * ) Notice: Subject to any disclaimer, the term of this patent is extended or adjusted under 35 U.S.C. 154(b) by 774 days.

(21) Appl. No.: 11/816,342

(22) PCT Filed: Feb. 16, 2006

(86) PCT No.: PCT/FI2006/000053

§ 371 (c)(1),
(2), (4) Date: Jul. 31, 2008

(87) PCT Pub. No.: WO2006/087417

PCT Pub. Date: Aug. 24, 2006

(65) Prior Publication Data

US 2009/0025166 A1 Jan. 29, 2009

(30) Foreign Application Priority Data

Feb. 16, 2005 (FI) ..... 20050175

(51) Int. Cl.
*A46B 13/00* (2006.01)

(52) U.S. Cl. ..... 15/183; 15/179

(58) Field of Classification Search ..... 15/171, 15/179–183, 194, 195, 197–202, 23; 300/10; 492/40

See application file for complete search history.

(56) References Cited

U.S. PATENT DOCUMENTS

| | | | | |
|---|---|---|---|---|
| 2,736,916 A | | 3/1956 | Lombardi | |
| 2,767,418 A | * | 10/1956 | Lombardi | 15/183 |
| 3,393,418 A | * | 7/1968 | Mundo | 15/183 |
| 3,715,773 A | | 2/1973 | Drumm | |
| 3,751,745 A | * | 8/1973 | Smith et al. | 15/183 |
| 3,869,833 A | * | 3/1975 | Belanger | 451/469 |
| 3,942,211 A | * | 3/1976 | Clark | 15/183 |
| 5,649,857 A | | 7/1997 | Suhrheinrich et al. | |

FOREIGN PATENT DOCUMENTS

SU 738594 6/1980

* cited by examiner

*Primary Examiner* — Dung Van Nguyen
(74) *Attorney, Agent, or Firm* — McAndrews, Held & Malloy, Ltd.

(57) ABSTRACT

Arrangement for fixing brush elements (9, 10) to a rotatable brush frame formed of shaft (3) and flanges fixed to it and in which assembly the direction of bristles (9) is fitted essentially in the direction of the radius of the rotatable brush unit. Brash elements (9, 10) are locked on shaft (3) by means of oblong elements, as tubes (1) in shaft (3) direction, which tubes are from their both ends fixed to flanges in order to remain in place by means of parts in the flanges, which parts are from the end of tubes (1) fitted to the inside of the tubes.

14 Claims, 1 Drawing Sheet

ARRANGEMENT FOR COUPLING BRUSH ELEMENTS IN A BRUSH BODY

This invention relates to an arrangement for coupling brush elements to a rotatable brush body, which is formed of a shaft and flanges connected to its ends. The direction of the bristles in the brush elements is fitted essentially in the direction of the radius of the rotatable brush unit and the brush elements are locked on the shaft by means of oblong elements, as tubes in the shaft direction. Usually the rotatable brush is cylindrical, which is rotated around a horizontal or vertical shaft. The shaft is supported from one end or its both ends.

Previously known as fixing method brush elements are grooves made in the shaft surface in the shaft direction. Mostly there are around the shaft 10-20 grooves. The brush elements are pushed from the end into these grooves. However, from the end the flange must be removed so that at first the worn out brushes can be removed and replaced with new ones. Often the removal of flange means that the shaft must be removed from above the bearings. Only the vertical brush fixed with bearings from its other end is a little easier to be broken up for replacement, since after removal of the flange, the brush elements can be removed from the shaft grooves. If the vertical brush by replacement be turned into another position, the change of bristles from the underside to the vertical shaft is very inconvenient.

Fixing of brush elements to a rotatable brush carried out by means of rods is known from patent publication U.S. Pat. No. 3,715,773, where the rods are taken through the end flanges, their ends furnished with a thread and tightened screwing the nuts into the threads. For the replacement of brush elements at least half of the rods must be removed threading them out through the holes of the flanges, which is a difficult stage.

In order to eliminate the above presented disadvantages a new assembly is developed for fixing of brush elements to a rotatable shaft. The assembly according to the invention is characterized in that the elements, as tubes, are from their both ends fixed to flanges by means of parts in said flanges, which parts are from the element ends fitted inside the elements.

The advantage of the arrangement according to the invention, is that in spite of the fixing of brush shaft with bearings regardless of the flanges in the shaft ends the brush elements can easily be replaced without removing neither of the flanges. From the oblong elements, as tubes, fitted on the shaft surface only every other must be removed, all brush elements are then replaced For these tubes even only one end removal is enough. Removal of the other tube ends is a relatively easy measure, when only every other tube end must be removed. As to its fixing end the brush frame can easily be made broader, whereby the elements remain on two adjacent tubes. The brush elements can be slided from the shaft end, where the tube is removed to the under side of the tubes and further to the shaft other end. By stress the tubes receive bending bristles and prevent formation of sharp bends in the bristles.

In the following the invention is disclosed with reference to the enclosed drawing, where FIG. 1 shows the brush shaft and fixing means of the brush elements from the side.

Figure 1:
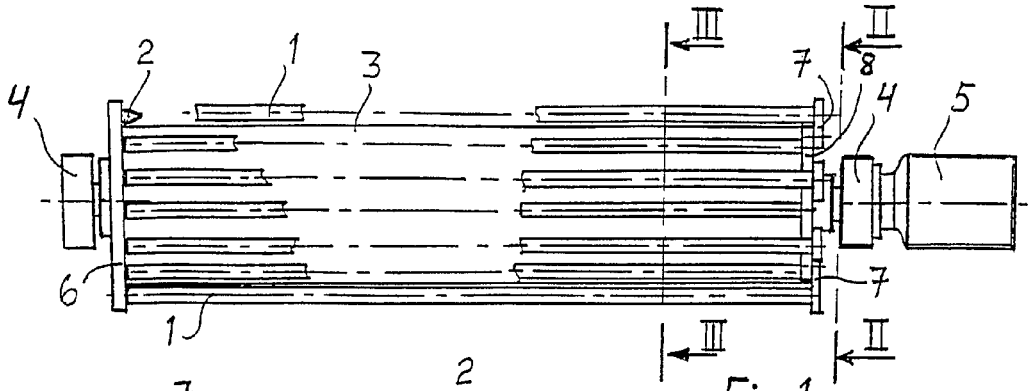

FIG. 1 is a side view of a rotatable brush frame fastened with bearings from its both ends. Through bearing housings 4 the brush frame is fixed to the working machine. In the right end there is a rotating motor 5. The brush frame has a shaft 3 and flanges 6 and 8 fixed to its both ends. Between flanges 6 and 8 a necessary number of tubes 1 are fitted, which remain in place by means of short parts 2 fitted in the flanges. Most properly parts 2 are conical and fitted from the tube end inside the tube. Conical part 2 supports the tube end free from backlash and allows also the tube to turn, when it is removed from its one end. In the left side flange 6 all parts 2 are firmly fixed to flange 6.

Figure 2:
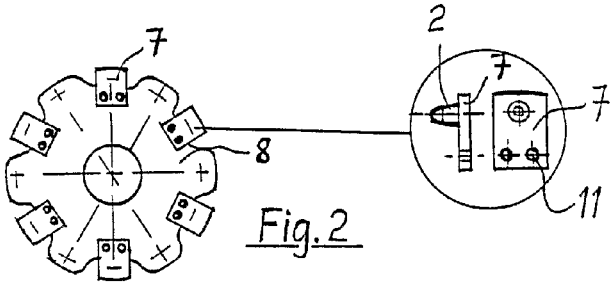
FIG. 2 shows the end flange from direction II.
Figure 3:
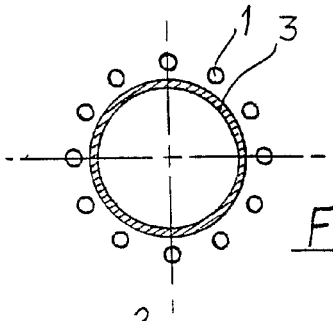
FIG. 3 shows a section of the brush frame from direction III.
Figure 5:
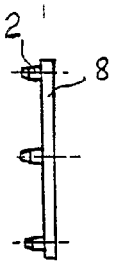
FIG. 5 shows the end flange from the side.

The right side flange 8 is according to FIGS. 2 and 5 and in it every other part 2 is fixed to flange 8 and every other part 2 is removable by means of connecting piece 7 fixed to flange 8. Connecting pieces 7 are most properly fixed by screws 11. Thus, from flange 8 six connecting pieces 7 must be removed, whereby the right end of the other tube 1 can be loosened and lifted a little up from shaft 3.

Figure 4:
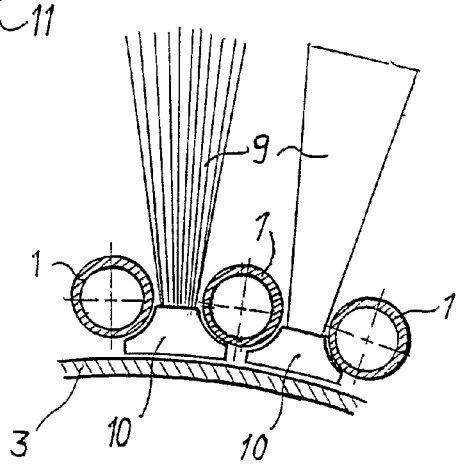
FIG. 4 shows fixing of brush elements on the shaft surface.

When the fixing of brush elements 9, 10 is according to FIG. 4, then by lifting the other tube 1 a little frame 10 of the brush element 1 can be turned and removed from of tube 3 surface. When brush elements 9,10 have a certain horizontal length, for instance 500 mm, they can be slided one after another also from the brush other end to the end, where tube 1 has been lifted off tube 3. Thus all replacements of brush elements can be made from the other brush end removing every other connecting piece 7 in turns. Thus the replacement of brush elements takes little time, since 2 adjacent rows of brush elements 9, 10 can be removed at the same time by removing the end of one tube 1. The tubular fixing means is advantageous for fixing frame 10 of the brush element, since it yields also under stress. According to FIG. 4, when the bristles bend strongly, they turn to lean against tube 1. Then in the connecting point of bristles 9 and frame 10 there will b no sharp bending point. Under stress frame 10 also turns a little along with the bristles Also frame 10 itself can bend under stress, if for instance its material is flexible, for instance cast plastic.

In the horizontal brush model, instead of the solution in FIG. 1, there can be in connection with flange 6 parts 2 fixed by means of connection piece 7. Thus there can be a flange like flange 8 in both ends of shaft 3. The detachable connection pieces 7 are fitted so that only the other end of each tube is by means of connection piece 7 is fixed to flange 8.

In the vertical brush model, in which the brush fixing with bearings and suspension is only in the other shaft end, usually in the upper end, it is advantageous regarding the replacement of brush elements that the connecting pieces 7 are placed in the flange in the brush upper end. Tube 1 can be held in place even it is loosened from the brush upper end, and the brush elements can be slided and replaced over the upper end to both sides of the loosened tube.

The invention claimed is:

1. Arrangement for fixing brush elements to a rotatable brush frame formed of shaft and flanges fixed to it and in which assembly the direction of bristles is fitted essentially in the direction of the radius of the rotatable brush frame and brush elements are locked on shaft by means of tube elements, arranged in the direction of shaft, wherein the tube elements are from their both ends fixed to flanges by means of parts in said flanges, which parts are fitted to the inside of the tube elements.

2. Arrangement according to claim 1, wherein the parts in said flanges are conical.

3. Arrangement according to claim 1, wherein at least one part is detachably fitted into the flange.

4. Arrangement according to claim 1, wherein the brush element has in the fixing end a broadening which is fitted on the surface of shaft so that two adjacent locking tube elements cooperatively prevent the brush element from getting loose from shaft surface.

5. Arrangement according to claim 1, wherein one flange has parts fixed to flange and in the other flange at least every other part is detachable.

6. Arrangement according to claim 1, wherein in both flanges at least every other part is detachable, whereby the detachable parts are placed so that at least every other end of the tube element is fixed by means of detachable part.

7. Arrangement according to claim 1, wherein the tube elements are substantially circular in cross-section.

8. An arrangement for coupling brush elements to a rotatable brush frame, the brush frame comprising a shaft having flanges connected to the ends of the shaft, the flanges including a plurality of projecting parts; and brush elements secured to the shaft by tube elements, the brush elements including bristles fitted substantially in the direct of the rotatable shaft, wherein the tube elements are coupled to the flanges by fitting the projecting parts into the ends of the tube elements.

9. An arrangement according to claim 8, wherein the projecting parts are conical.

10. An arrangement according to claim 8, wherein at least one projecting part is detachably fitted into the flange.

11. An arrangement according to claim 8, wherein the brush element has in the fixing end a broadening portion which is fitted on the surface of shaft so that two adjacent tube elements cooperatively prevent the brush element from getting loose from the shaft surface.

12. An arrangement according to claim 8, wherein one flange has projecting parts fixed to flange and in the other flange at least every other projecting part is detachable.

13. An arrangement according to claim 8, wherein in both flanges at least every other projecting part is detachable, whereby the detachable projecting parts are placed so that at least every other end of tube elements is fixed by means of detachable projecting part.

14. An arrangement according to claim 8, wherein the tube elements are substantially circular in cross-section.

* * * * *